US010991312B2

(12) United States Patent
Park et al.

(10) Patent No.: US 10,991,312 B2
(45) Date of Patent: Apr. 27, 2021

(54) ORGANIC LIGHT EMITTING DISPLAY DEVICE

(71) Applicant: Samsung Display Co., Ltd., Yongin-si (KR)

(72) Inventors: Jin Woo Park, Seoul (KR); Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 95 days.

(21) Appl. No.: 16/133,562

(22) Filed: Sep. 17, 2018

(65) Prior Publication Data

US 2019/0096333 A1 Mar. 28, 2019

(30) Foreign Application Priority Data

Sep. 22, 2017 (KR) ..... 10-2017-0122617

(51) Int. Cl.
*G09G 3/3266* (2016.01)
*G09G 3/3258* (2016.01)
*G09G 3/3233* (2016.01)

(52) U.S. Cl.
CPC ..... *G09G 3/3266* (2013.01); *G09G 3/3233* (2013.01); *G09G 3/3258* (2013.01); *G09G 2310/0205* (2013.01); *G09G 2310/0221* (2013.01); *G09G 2310/08* (2013.01); *G09G 2320/0233* (2013.01)

(58) Field of Classification Search
None
See application file for complete search history.

(56) References Cited

U.S. PATENT DOCUMENTS 8,368,634 B2 * 2/2013 Moon ..... G11C 19/28 345/100
9,024,858 B2 * 5/2015 Koo ..... G09G 3/36 345/100
9,824,614 B2 * 11/2017 Lee ..... G09G 3/20
2003/0169247 A1 * 9/2003 Kawabe ..... G09G 3/3648 345/204
2006/0267912 A1 * 11/2006 Lee ..... G09G 3/3674 345/100
2007/0040792 A1 * 2/2007 Kwag ..... G09G 3/3666 345/100
2012/0249518 A1 * 10/2012 Won ..... G09G 3/3674 345/213

(Continued)

FOREIGN PATENT DOCUMENTS

KR 10-2018-0066327 6/2018
KR 10-2018-0066338 6/2018

*Primary Examiner* — Patrick N Edouard
*Assistant Examiner* — Peijie Shen
(74) *Attorney, Agent, or Firm* — H.C. Park & Associates, PLC

(57) ABSTRACT

An organic light emitting display device including: a display panel including a plurality of pixels; a gate driver including a plurality of stage groups each including at least one stage providing a gate signal to the pixels; a timing controller providing a first stage initiation signal or a second stage initiation signal to the at least one stage; and a first stage initiation line and a second stage initiation line transmitting the first stage initiation signal and the second stage initiation signal from the timing controller to the gate driver.

18 Claims, 14 Drawing Sheets

(56) References Cited

U.S. PATENT DOCUMENTS

| | | | | |
|---|---|---|---|---|
| 2012/0293762 | A1* | 11/2012 | Shin | G09G 3/3677 349/139 |
| 2013/0009938 | A1* | 1/2013 | Hwang | G09G 3/3644 345/212 |
| 2015/0022515 | A1* | 1/2015 | Ikeda | G09G 3/3233 345/212 |
| 2017/0025068 | A1* | 1/2017 | Jeoung | G09G 3/3677 |
| 2017/0154598 | A1* | 6/2017 | Park | G09G 3/3688 |
| 2017/0221411 | A1* | 8/2017 | Chang | G09G 3/36 |
| 2018/0075808 | A1* | 3/2018 | Yamashita | G09G 3/3266 |
| 2018/0158396 | A1 | 6/2018 | Lee et al. | |
| 2018/0158409 | A1 | 6/2018 | Byun et al. | |
| 2018/0197482 | A1* | 7/2018 | Choi | G09G 3/3266 |

* cited by examiner

ORGANIC LIGHT EMITTING DISPLAY DEVICE

This application claims priority from and the benefit of Korean Patent Application No. 10-2017-0122617, filed on Sep. 22, 2017, which is hereby incorporated by reference for all purposes as if fully set forth herein.

BACKGROUND

Field

Exemplary embodiments relate to an organic light emitting display device.

Discussion of the Background

An organic light emitting display device includes a display panel where organic light emitting diodes, in which organic material layers are laminated to emit light, are arranged. The display panel may express gradation in light output by controlling the amount of electric current flowing through an organic light emitting diode using a difference in voltage between both ends of the organic light emitting diode through a pixel circuit.

In order to efficiently drive the display panel, a mode of dividing a display area into several areas and driving these areas (hereinafter, referred to as a "split drive mode") has been proposed. Unlike a mode of driving a display panel to display an image over the entire display area (hereinafter, referred to as a "full drive mode"), when only a part of a display area displays an image, the split drive mode can be used.

However, when the characteristics of a drive transistor included in each pixel circuit controlling the amount of electric current flowing through an organic light emitting diode are not uniform over the entire display area, a luminance difference can be visually recognized by a user.

In particular, the characteristics of a drive transistor disposed in an area where an image is not displayed in the split drive mode are different from the characteristics of a drive transistor disposed in an area where an image is displayed in the split drive mode, so that a luminance difference can be visually recognized.

Such a luminance difference can be seen more remarkably when the split drive mode is ended and converted into the full drive mode of displaying an image using the entire display area.

The above information disclosed in this Background section is only for understanding of the background of the inventive concepts, and, therefore, it may contain information that does not constitute prior art.

SUMMARY

An exemplary embodiment of the invention provides an organic light emitting display device in which a luminance difference for each area is minimized even when a split drive mode is used.

Additional features of the invention will be set forth in the description which follows, and in part will be apparent from the description, or may be learned by practice of the invention.

An exemplary embodiment of the invention provides an organic light emitting display device including: a display panel including a plurality of pixels; a gate driver including a plurality of stage groups each including at least one stage providing a gate signal to the pixels; a timing controller providing a first stage initiation signal or a second stage initiation signal to the at least one stage; and a first stage initiation line and a second stage initiation line transmitting the first stage initiation signal and the second stage initiation signal from the timing controller to the gate driver.

The first stage initiation line may be connected with one of the stage groups, and the second stage initiation line may be connected with at least two of the stage groups.

The display panel may include a display area on which an image is displayed by the pixels.

The first stage initiation signal may be activated when an image is displayed on the entire display area.

The second stage initiation signal may be activated when an image is displayed on a part of the entire display area.

The gate driver may provide a light emission control signal for determining whether or not to emit light to the plurality of pixels.

The gate driver may provide the light emission control signal having a voltage value of an ON level to the pixels disposed in a part of the display area on which an image is displayed.

Each of the stages may control whether or not a sequential initiation signal activating the other successively disposed stages is provided.

Each of the stages may provide the sequential initiation signal when the other successively disposed stages are not connected with the second stage initiation line.

The first stage initiation signal and the second stage initiation signal may be selectively activated.

Any one of the at least two stage groups connected with the second stage initiation line may be the stage group which connected with the first stage initiation line.

Another exemplary embodiment of the invention provides an organic light emitting display device, including: a display panel including a plurality of pixels; a gate driver including a plurality of stage groups, each including at least one stage providing a gate signal to the pixels; a timing controller providing any one of first to third stage initiation signals to the at least one stage; and first to third stage initiation lines transmitting the first to third stage initiation signals from the timing controller to the gate driver.

The first stage initiation line may be connected with one of the stage groups, and the second and third stage initiation lines may be connected with at least two of the stage groups.

The display panel may include a display area on which an image is displayed by the pixels.

The second stage initiation signal or the third stage initiation signal may be activated when an image is displayed on a part of the display area.

The first stage initiation line may be connected with the one stage group, the second stage initiation line may be connected with at least two of the stage groups, and the third stage initiation line may be connected with at least one of the stage groups not connected with the second stage initiation line.

The second stage initiation signal and the third stage initiation signal may be activated at least one time in one frame.

The gate driver may provide a light emission control signal for determining whether or not to emit light to the plurality of pixels, and the light emission control signal may be provided to the pixels disposed in a part of the display area activated by the third stage initiation signal.

The pixels disposed in a part of the display area activated by the third stage initiation signal may receive a predetermined data voltage.

Only one of the first to third stage initiation signals may be selectively activated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION OF THE ILLUSTRATED EMBODIMENTS

Figure 1:
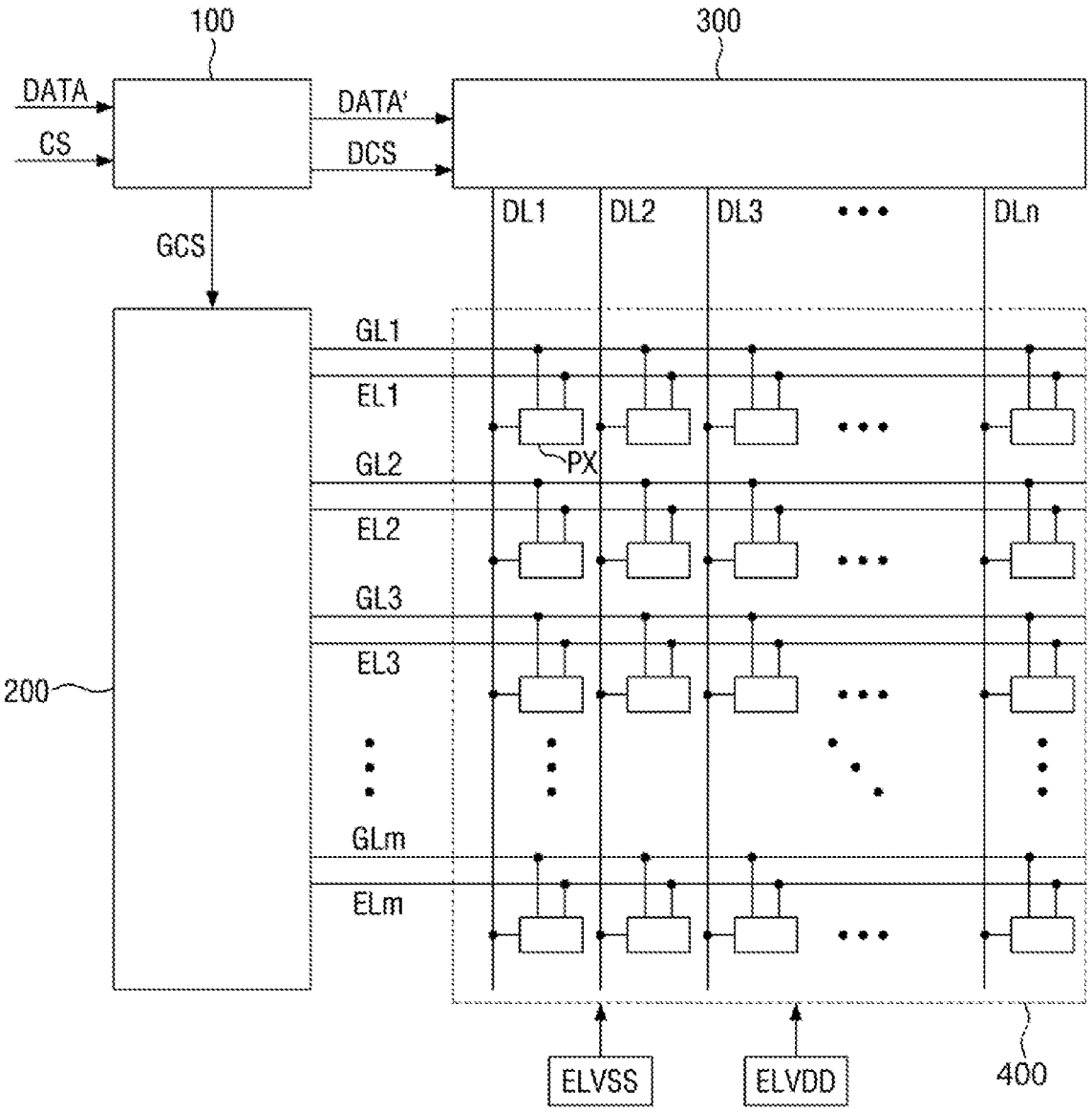
FIG. 1 is a block diagram of an organic light emitting display device according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Features of the invention and methods of accomplishing the same may be understood more readily by reference to the following detailed description of preferred embodiments and the accompanying drawings. The invention may, however, be embodied in many different forms and should not be construed as being limited to the embodiments set forth herein. Rather, these embodiments are provided so that this disclosure will be thorough and complete and will fully convey the concept of the invention to those skilled in the art, and the invention will only be defined by the appended claims.

Like numbers refer to like elements throughout. As used herein, the term "and/or" includes any and all combinations of one or more of the associated listed items.

Hereinafter, embodiments of the present invention will be described with reference to the attached drawings.

FIG. 1 is a block diagram of an organic light emitting display device according to an exemplary embodiment.

Referring to FIG. 1, an organic light emitting display device includes a timing controller 100, a gate driver 200, a data driver 300, and a display panel 400.

The display panel 400 may include a plurality of pixels PX, a plurality of gate lines GL1 to GLm, a plurality of light emission control lines EL1 to Elm, and a plurality of data lines DL1 to DLn. Each pixel PX includes an organic light emitting diode (OLED). The plurality of pixels PX may be arranged in a matrix form. In an exemplary embodiment, the number of gate lines GL1 to GLm or the number of light emission control lines EL1 to Elm may be m (m is a natural number). The number of data lines DL1 to DLn may be n (n is a natural number). In an exemplary embodiment, the number of pixels PX may be m*n.

In an exemplary embodiment, each pixel PX may receive a first power ELVDD and a second power ELVSS from the outside and emit light corresponding to image data DATA'. Each pixel PX may include a pixel circuit including an OLED and be connected to one of the data lines DL1 to DLn, one of the gate lines GL1 to GLm, and one of the light emission control lines EL1 to Elm.

The timing controller 100 controls the gate driver 200 and the data driver 300. The timing controller 100 may receive an input control signal CS and input image data DATA from an image source, such as an external graphic device. The input control signal CS may include a main clock signal, a vertical synchronization signal, a horizontal synchronization signal, and a data enable signal.

The timing controller 100 may generate image data DATA' and a data control signal DCS for controlling the data driver 300 in accordance with the operation conditions of the display panel 400 based on the input image data DATA and the input control signal CS, and may provide the image data DATA' and the data control signal DCS to the data driver 300.

Further, the timing controller 100 may generate a gate control signal GCS for controlling the gate driver 200 based on the input image data DATA and the input control signal CS, and may provide the gate control signal GCS to the gate controller 200.

The data driver 300 transmits data signals to n data line DL1 to DLn.

This data driver 300 may include a plurality of data driver integrated circuits (ICs). The plurality of data driver ICs may be connected to a bonding pad of the display panel 400 by a tape automated bonding (TAB) method or a chip on glass (COG) method, or the plurality of data driver ICs may be directly integrated with the display panel 400.

The gate driver 200 sequentially transmits gate signals to m gate line GL1 to GLm, and includes a plurality of gate driver integrated circuits (ICs).

The gate driver 200 may be disposed at one side of the display panel 400, as shown in FIG. 1, or at both sides of the display panel 400, depending on a driving method.

The plurality of gate driver ICs included in the gate driver 200 may be connected to the bonding pad of the display panel 400 by a tape automated bonding (TAB) method or a chip on glass (COG) method or the plurality of gate drivers ICs may be directly integrated with the display panel 400.

The gate driver 200 may sequentially output light emission control signals EM to light emission control lines EL1 to ELm for each frame. The activation level period of the light emission control signals EM may correspond to the light emission period of the organic light emitting diode OLED, and the inactivation level period of the light emission control signals EM may correspond to the non-light emission period of the organic light emitting diode OLED. However, in this exemplary embodiment, there is exemplified a structure in which the gate driver 200 is connected to the light emission control lines EL1 to Elm to output the light emission signals EM, but the inventive concepts are not limited thereto. Alternatively, a separate light emission controller may provide the light emission control signals EM to the light emission control lines EL1 to ELm.

Figure 2:
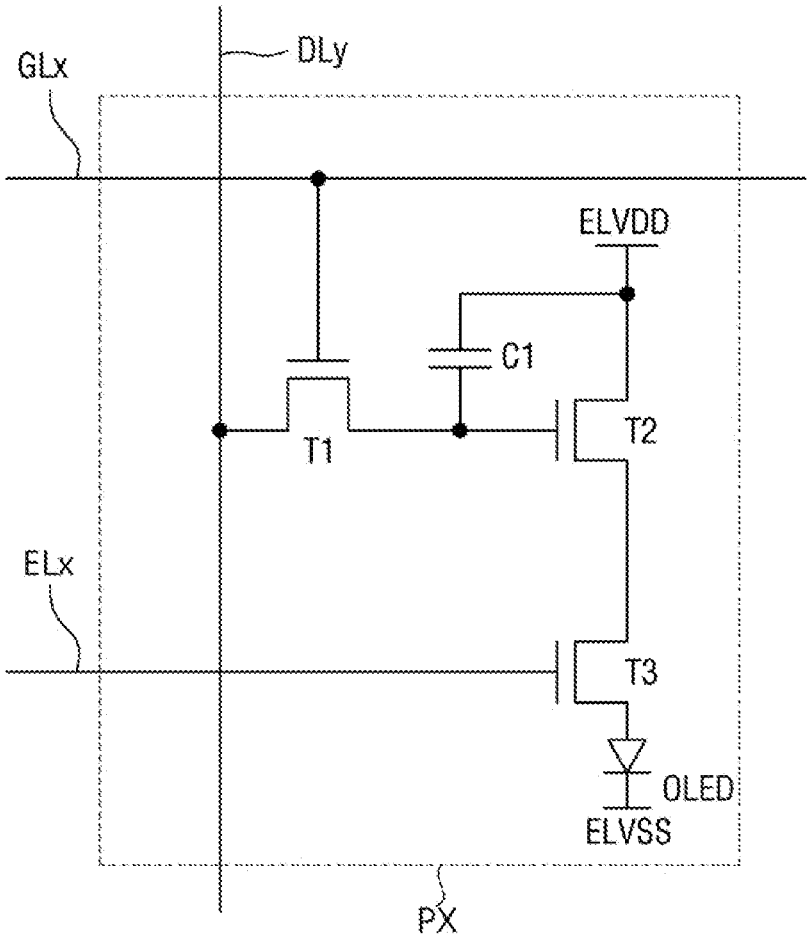
FIG. 2 is a schematic circuit diagram of an example of pixels included in a display panel of the organic light emitting display device of FIG. 1.

FIG. 2 is a schematic circuit diagram of an example pixel included in the display panel of the organic light emitting display device of FIG. 1.

Referring to FIG. 2, each pixel PX includes an organic light emitting diode OLED and a circuit for controlling the organic light emitting diode OLED. The circuit includes a first transistor T1, a second transistor T2, a third transistor T3, and a first capacitor C1.

The first transistor T1 may include a control electrode connected to a gate line GLx, an input electrode connected to a data line DLy, and an output electrode. The first transistor T1 may output a data signal applied to the data line DLy in response to a gate signal applied to the gate line GLx.

The first capacitor C1 may include a first electrode connected to the first transistor T1 and a second electrode receiving a first power voltage ELVDD. The first capacitor C1 may charge a voltage corresponding to the data signal received from the first transistor T1.

The second transistor T2 may include a control electrode connected to the output electrode of the first transistor T1 and the first electrode of the first capacitor C1, an input electrode receiving the first power voltage ELVDD, and an output electrode. The second transistor T2 may control the amount of driving current flowing through the organic light emitting diode OLED in response to a voltage stored in the first capacitor C1.

The third transistor T3 may include a control electrode connected to a light emission control line ELx to receive a light emission control signal EM, an input electrode connected to the output electrode of the second transistor T2, and an output electrode connected to the organic light emitting diode OLED. The third transistor T3 may control whether the organic light emitting diode emits light.

The organic light emitting diode OLED may include a first electrode connected to the second transistor T2 to receive the first power voltage ELVDD and a second electrode receiving a second power voltage ELVSS. Further, the organic light emitting diode OLED may include a light emitting layer disposed between the first electrode and the second electrode.

Figure 3:
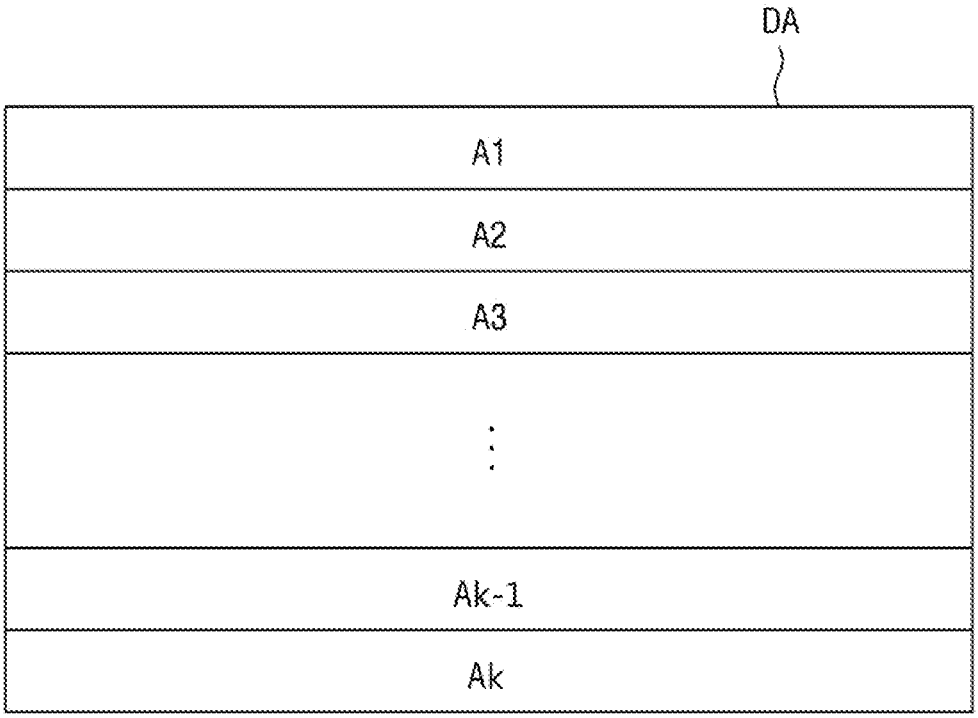
FIG. 3 and FIG. 4 are schematic views showing a display panel according to an exemplary embodiment of the invention.
Figure 4:
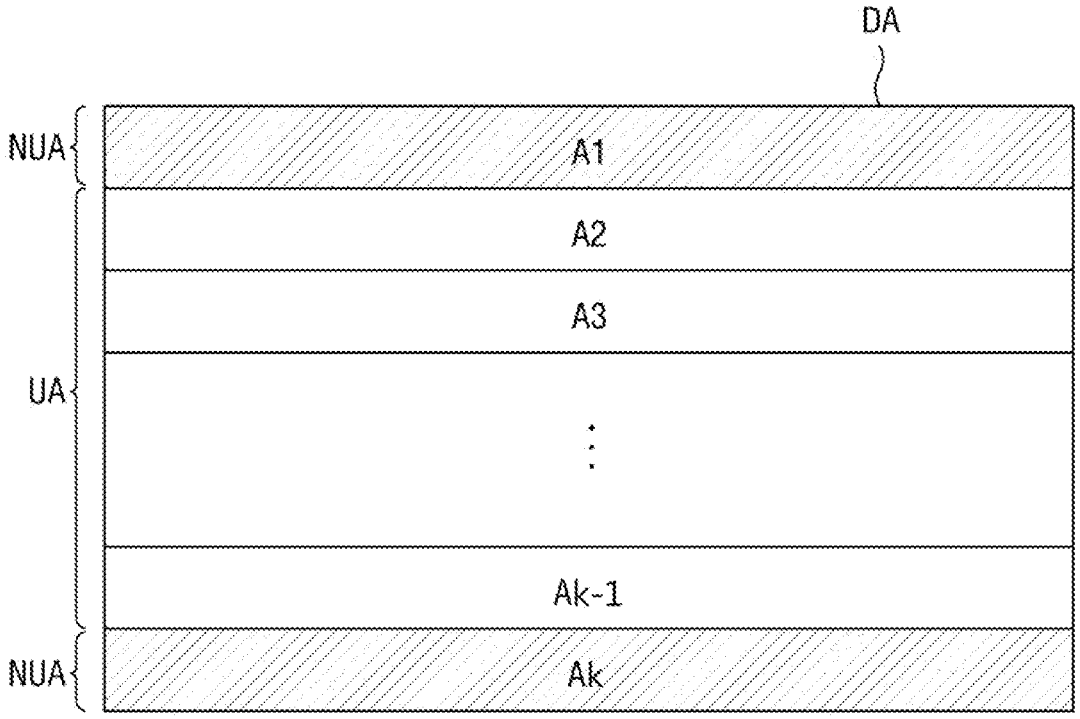

FIGS. 3 and 4 are schematic views showing a display panel according to an exemplary embodiment.

Referring to FIGS. 3 and 4, the display panel 400 may include a display area DA where pixels PX are arranged to display an image to a user.

The display area DA may include first to k-th divided areas A1 to Ak (k is a natural number). Here, each of the first to k-th divided areas A1 to Ak may include a plurality of pixels PX arranged therein. Where the display device is divided and driven, only pixels PX arranged in some of the first to k-th divided areas A1 to Ak can emit light.

For example, as shown in FIG. 4, the first divided area A1 and the Ak-th divided area may correspond to non-used areas NUA not displaying an image, and the second to k−1-th divided areas A2 to Ak−1 may correspond to used areas UA displaying an image.

Such divided driving may be used in various cases such as a case where an organic light emitting display device mounted with a head mounted display device (HMD) is used, a case where an organic light emitting display device is used for watching movies, and the like.

Figure 5:
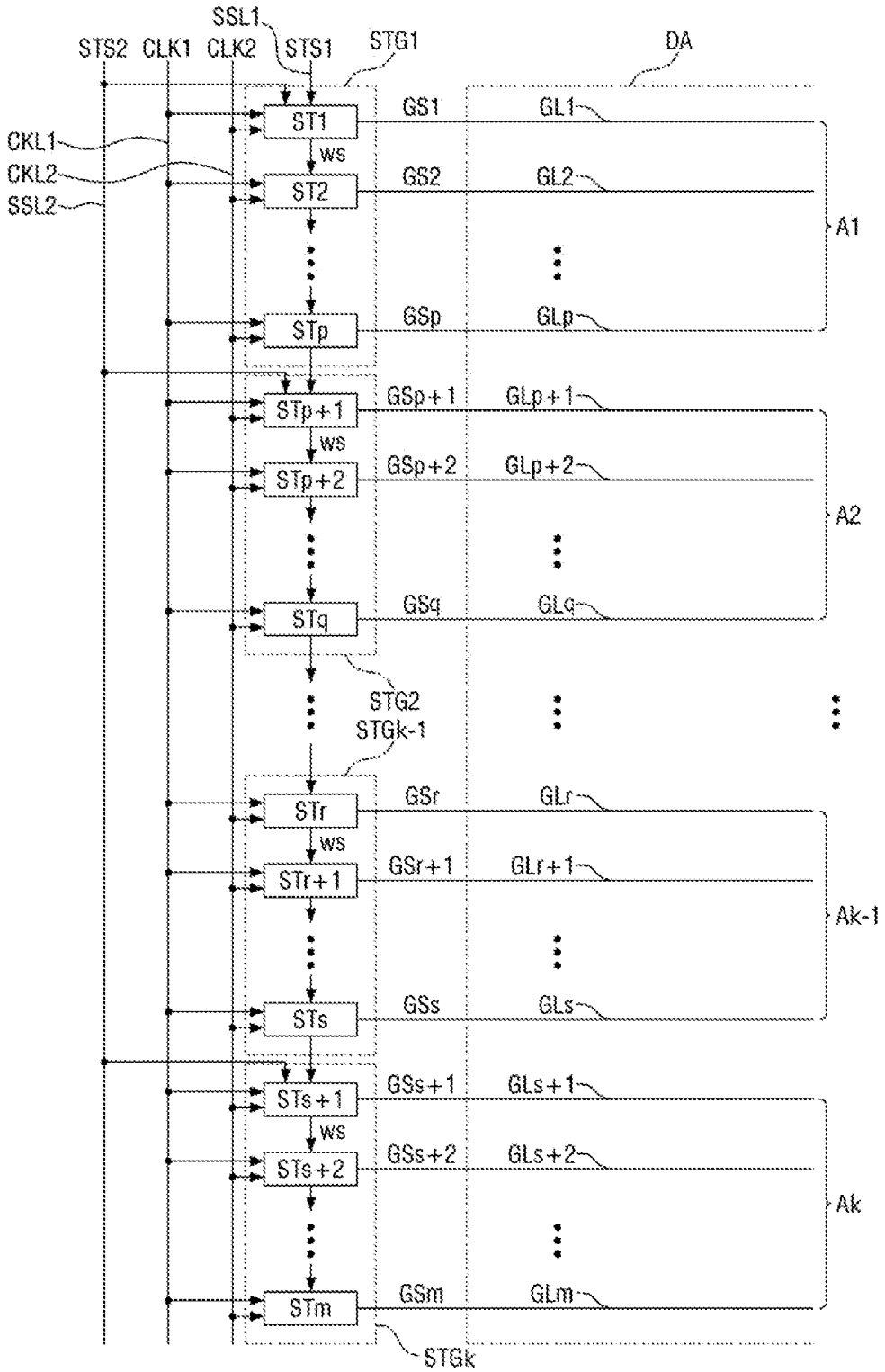
FIG. 5 is a block diagram of a gate driver according to an exemplary embodiment of the invention.

FIG. 5 is a block diagram of a gate driver according to an exemplary embodiment.

Referring to FIG. 5, the gate driver 200 includes first to k-th stage groups STG1 to STGk.

Each of the first to k-th stage groups STG1 to STGk includes a plurality of stages ST1 to STm.

For example, the first stage group STG1 may include first to p-th stages ST1 to STp. The second stage group STG2 may include p+1-th to q-th stages STp+1 to STq. The k−1-th stage group STGk−1 may include r-th to s-th stages STr to STs. The k-th stage group STGk may include s+1-th to m-th stages STs+1 to STm (p, q, r, s are natural numbers satisfying $p<q<r<s<m$).

Each of the first to k-th stage groups STG1 to STGk may provide gate signals GS1 to GSm to the display area DA. For example, the first stage group STG1 may provide first to p-th gate signals GS1 to GSp to the first divided area A1. The second stage group STG2 may provide p+1-th to q-th gate signals GSp+1 to GSq to the second divided area A2. The k−1-th stage group STGk−1 may provide r-th to s-th gate signals GSr to GSs to the k−1-th divided area Ak−1. The k-th stage group STGk may provide s+1-th to m-th gate signals GSs+1 to GSm to the k-th divided area Ak.

Each of the stages ST1 to STm may be connected with gate lines GL1 to GLm, and may generate gate signals GS1 to GSm in response to input signals and provide these gate signals GS1 to GSm to the gate lines GL1 to GLm.

That is, the gate driver 200 may include the plurality of stage groups STG1 to STGk each including the plurality of stages ST1 to STm. These the stage groups STG1 to STGk may drive the display panel 400 so as to correspond one to one to the respective divided areas A1 to Ak.

Each of the stages ST1 to STm may receive a first clock signal CLK1 and a second clock signal CLK2. The first clock signal CLK1 and the second clock signal CLK2 may have the same period, and the second clock signal CLK2 may be a signal obtained by shifting the first clock signal CLK1 by a half period. In other words, the first clock signal CLK1 and the second clock signal CLK2 may be opposite to each other in phase.

Each of the stages ST1 to STm may generate gate signals GS1 to GSm in response to the input of an initiation signal and provide these gate signals to the gate lines GL1 to GLm. Further, each of the stages ST1 to STm may receive an initiation signal and then provide the initiation signal to each of the next stages ST2 to STm. In other words, when an initiation signal is provided to each of the stages ST1 to STm, the successively arranged next stages ST2 to STm may sequentially generate the gate signals GS2 to GSm.

However, each of the stages ST1 to STm may not provide an initiation signal to each of the next stages ST2 to STm in accordance with the drive mode of the organic light emitting display device. Further, depending on the drive mode of the organic light emitting display device, the kinds of initiation signals input to the respective stages ST1 to STm may be different, and the timing at which the initiation signals are provided may be different. The initiation signal provided from the outside of the gate driver 200 may be a kind of the gate control signal GCS received from the timing controller 100.

Specifically, the initiation signal may include a first stage initiation signal STS1, a second stage initiation signal STS2, and a sequential initiation signal WS. Here, the first stage initiation signal STS1 and the second stage initiation signal STS2 cannot be provided at the same time, and can be selectively provided according to the drive mode of the organic light emitting display device. Further, in the case of the sequential initiation signal WS provided to each of the next stage ST2 to STm by each of the stages ST1 to STm, whether or not the sequential initiation signal WS is generated may be determined according to the drive mode of the organic light emitting display device.

The first stage initiation signal STS1 may be provided to the first stage ST1 through a first stage initiation line SSL1.

The first stage ST1 having received the first stage initiation signal STS1 may provide the first gate signal GS1 to the first gate line GL1. Simultaneously, the first stage ST1 may provide the sequential initiation signal WS to the second stage ST2. The second stage ST2 having received the sequential initiation signal WS may provide the second gate signal GS2 to the second gate line GL2. Here, the sequential initiation signal WS generated by the first stage ST1 may be the same signal as the first gate signal GS1.

When the first stage initiation signal STS1 is provided to the first stage ST1 through the first stage initiation line SSL1, the first to m-th stages ST1 to STm may sequentially output the first to m-th gate signals GS1 to GSm. In this case, an image can be displayed through all the divided areas A1 to Ak of the display area DA.

The second stage initiation signal STS2 may be provided to the first stage ST1, the p+1-th stage STp+1, and the s+1-th stage STs+1 through a second stage initiation line SSL2. In other words, the second stage initiation line SSL2 may be connected with the first stage ST1, the p+1-th stage STp+1, and the s+1-th stage STs+1.

The first stage ST1 having received the second stage initiation signal STS2 may provide the first gate signal GS1 to the first gate line GL1. Simultaneously, the first stage ST1 may provide the sequential initiation signal WS to the second stage ST2. However, unlike the case where the organic light emitting display device is driven by the first stage initiation signal STS1, when the organic light emitting display device is driven by the second stage initiation signal STS2, only the first to p-th stages ST1 to STp may be sequentially activated. That is, since the p+1-th stage STp+1 is directly activated by the second stage initiation signal STS2, only the first to p-th stages ST1 to STp may be sequentially activated. In other words, the second stage initiation signal STS2 provided to the first stage ST1 may sequentially activate from the first stage ST1 to the stage (for example, p-th stage STp) prior to another stage having received the second stage initiation signal STS2 (for example, p+1-th stage STp+1). That is, the initiation signal provided to the first stage ST1 may provide the gate signals GS1 to GSp to the first divided area A1.

The p+1-th stage STp+1 having received the second stage initiation signal STS2 may provide the p+1-th gate signal GSp+1 to the p+1-th gate line GLp+1. Simultaneously, the p+1-th stage STp+1 may provide the sequential initiation signal WS to the p+2-th stage STp+2. Thereafter, the p+1-th stage STp+1 to the stage (for example, S-th stage STS) prior to another stage having received the second stage initiation signal STS2 (for example, s+1-th stage STs+1) may be sequentially activated. That is, the initiation signal provided to the p+1-th stage STp+1 may provide the gate signals GSp+1 to GSs to the second to k−1-th divided areas A2 to Ak−1.

The s+1-th stage STs+1 having received the second stage initiation signal STS2 may provide the s+1-th gate signal GSs+1 to the s+1-th gate line GLs+1. Simultaneously, the s+1-th stage STs+1 may provide the sequential initiation signal WS to the s+2-th stage STs+2. Thereafter, the s+1-th stage STs+1 to the final stage STm may be sequentially activated. That is, the initiation signal provided to the s+1-th stage STs+1 may provide the gate signals GSs+1 to GSm to the second to k-th divided areas Ak.

Here, since the first stage ST1, the p+1-th stage STp+1, and the s+1-th stage STs+1 simultaneously receive the second stage initiation signal STS2, they may be simultaneously activated.

Like this, when the first stage initiation signal STS1 has a voltage value of an ON level and the second stage initiation signal STS2 has a voltage value of an ON level, the timings at which the stages ST1 to STm are activated may be different from each other.

In this exemplary embodiment, a structure in which the second stage initiation line SSL2 is connected to the three stages ST1, STp+1, and STs+1 is exemplified, but this may be changed in some cases. That is, in some exemplary embodiments, the second stage initiation line SSL2 may be connected to a greater number of stages. Accordingly, the number of stages to be simultaneously activated may increase.

Hereinafter, a method of displaying an image according to the structure of the gate driver 200 shown in FIG. 5 will be described.

Figure 6:
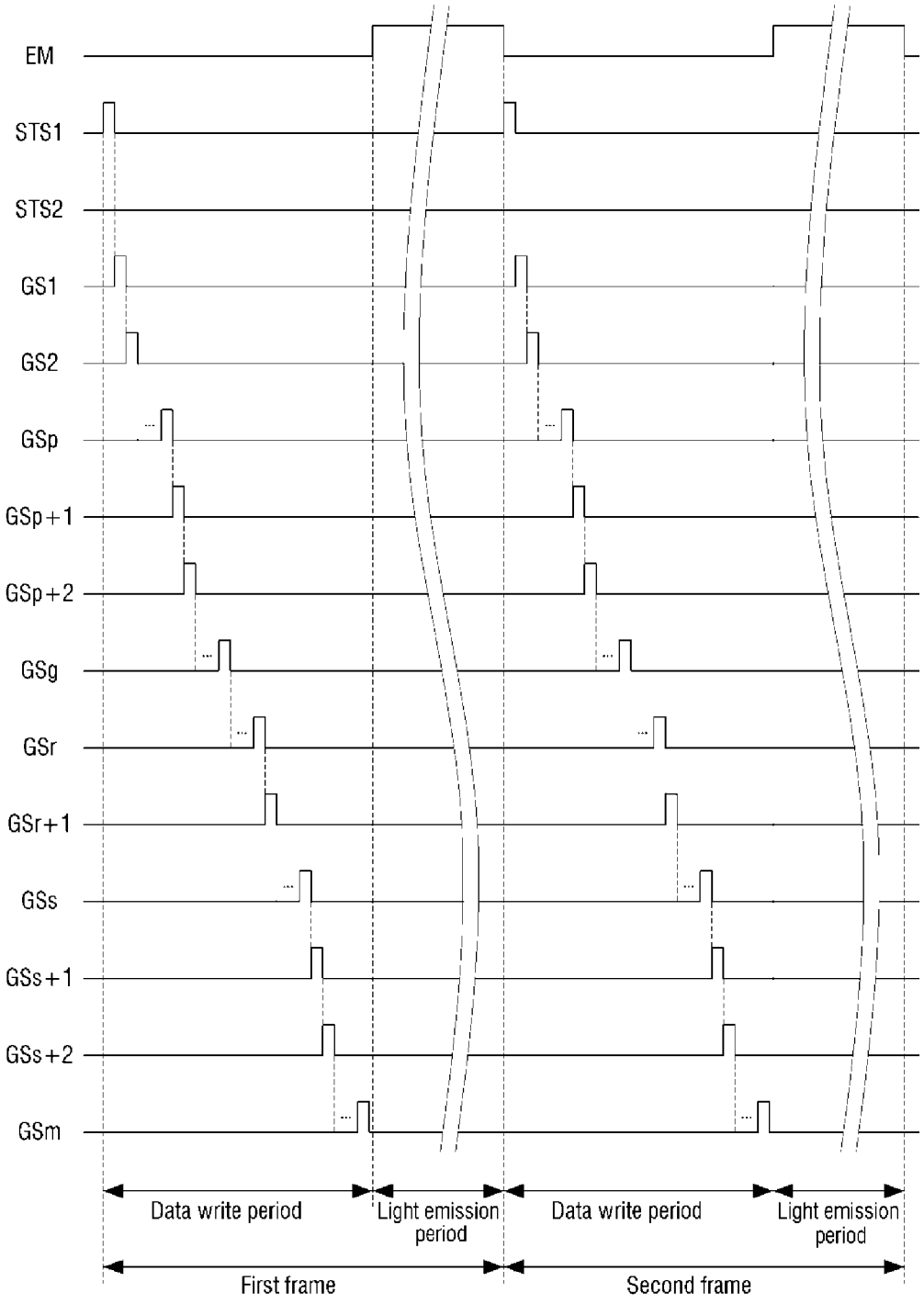
FIG. 6 is a timing chart showing the waveforms of various signals when an organic light emitting display device is driven according to a full drive mode.

FIG. 6 is a timing chart showing the waveforms of various signals when an organic light emitting display device is driven according to a full drive mode.

For convenience of explanation, in FIG. 6, the waveforms of signals during two frame periods are shown. Further, for convenience of explanation, it is assumed that when a transistor receiving a signal has a high level based on FIG. 6, the corresponding signal may have a voltage value of an ON level, and when this transistor has a low level based on FIG. 6, the corresponding signal may have a voltage value of an OFF level, without determining whether this transistor is a P-type transistor or an N-type transistor. Hereinafter, the meaning that any signal is activated refers to an operation in which a signal is changed to a voltage value of an ON level and then changed to a voltage value of an OFF level again.

Referring to FIG. 6, each frame period may be divided into a data write period and a light emission period.

The data write period may be a period during which the gate signals GS1 to GSm having a voltage value of an ON level are sequentially provided from the data driver 200 to activate the first transistor T1 of each pixel PX and charge a voltage in the first capacitor C1. During the data write period, the light emission control signal EM maintains a voltage value of an OFF level. Thus, during the data write period, the organic light emitting diode OLED may not emit light.

The light emission period may be a period during which the light emission control signal EM having a voltage value of an ON level is provided from the gate driver 200, and thus, the organic light emitting diode OLED included in each pixel PX actually emits light. Here, the organic light emitting diode OLED may receive an electric current from the second transistor T2 in response to the amount of electric charges in the first capacitor C1 during the data write period. The light emission intensity of the organic light emitting diode OLED may be determined in response to the amount of electric current.

First, during the data write period of the first frame, the first stage initiation signal STS1 is activated. Thus, the first stage ST1 activates the first gate signal GS1 in response to the first stage initiation signal STS1. Then, during the remaining data write period, the second to m-th gate signals GS2 to GSm are sequentially activated.

Next, during the light emission period of the first frame, the light emission control signal EM maintains a voltage value of an ON level. Here, the light emission control signal EM may provided to pixels PX disposed in all divided areas A1 to Ak. Thus, the pixels PX disposed in all divided areas A1 to Ak may emit light, and an image of one frame may be displayed.

Next, in the second frame, the same operations as those of the first frame can be repeatedly performed.

After, before, or between the data write period and the light emission period, a sensing and compensation period for preventing the deterioration of the organic light emitting diode OLED may be added, and an initialization period of the second transistor T2 for improving the display quality of the organic light emitting diode OLED for each pixel PX may also be added.

Figure 7:
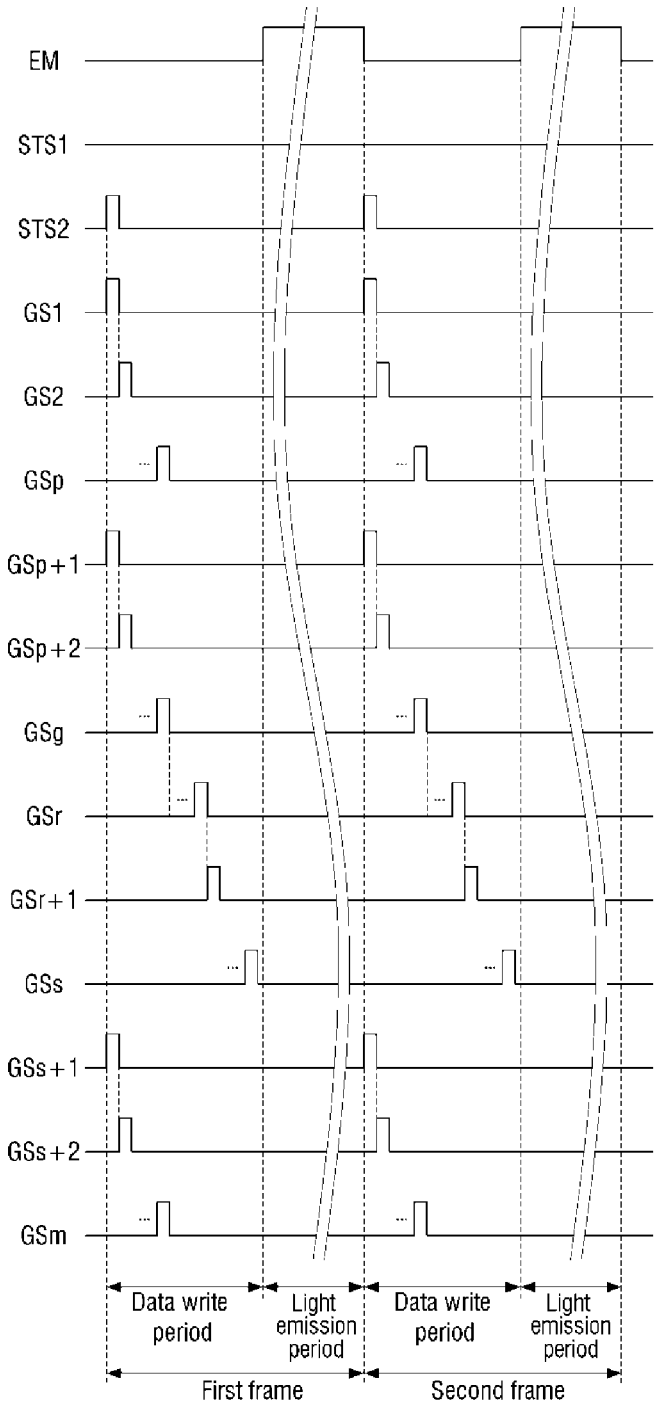
FIG. 7 is a timing chart showing the waveforms of various signals when an organic light emitting display device is driven according to a split drive mode.

FIG. 7 is a timing chart showing the waveforms of various signals when an organic light emitting display device is driven according to a split drive mode.

Referring to FIG. 7, each frame period may be divided into a data write period and a light emission period.

The data write period may be a period during which the gate signals GS1 to GSm having a voltage value of an ON level are sequentially provided from the data driver 200 to activate the first transistor T1 of each pixel PX and charge a voltage in the first capacitor C1. During the data write period, the light emission control signal EM maintains a voltage value of an OFF level. Thus, during the data write period, the organic light emitting diode OLED may not emit light.

The light emission period may be a period during which the light emission control signal EM having a voltage value of an ON level is provided from the gate driver 200, and thus, the organic light emitting diode OLED included in each pixel PX actually emits light. Here, the organic light emitting diode OLED may receive an electric current from the second transistor T2 in response to the amount of electric charges in the first capacitor C1 during the data write period. The light emission intensity of the organic light emitting diode OLED may be determined in response to the amount of electric current.

First, during the data write period of the first frame, the second stage initiation signal STS2 is activated.

Thus, the first stage ST1, the p+1-th stage, and the s+1-th stage, having received the second stage initiation signal STS2, may activate the first gate signal GS1, the p+1-th gate signal GSp+1, and the s+1-th gate signal GSs+1, respectively. Here, since the first gate signal GS1, the p+1-th gate signal GSp+1, and the s+1-th gate signal GSs+1 are simultaneously activated by the second stage initiation signal STS2, the first capacitor C1 of the pixels PX arranged in the same pixel columns as the first, p+1-th and s+1-th pixel rows may be charged by the same data voltage.

Then, the second to p-th gate signals GS2 to GSp, the p+2-th to s-th gate signals GSp+1 to GSs, and the s+2-th to m-th gate signals GSs+2 to GSm are sequentially activated.

Here, since the second gate signal GS2, the p+2-th gate signal GSp+1, and the s+2-th gate signal GSs+2 may be simultaneously activated, the first capacitor C1 of the pixels PX arranged in the same pixel columns as the second, p+2-th and s+2-th pixel rows may be charged by the same data voltage.

Next, during the light emission period of the first frame, the light emission control signal EM is maintained at a voltage value of an ON level. Here, the light emission control signals EM provided to all of the light emission control lines EL1 to Elm may not have a voltage value of an ON level, but only the light emission control signals EM provided to the pixels PX arranged in the divided area on which an image is displayed in a split drive mode may have a voltage value of an ON level.

For example, the light emission control signals EM having a voltage value of an ON level may be provided to only the pixels having received the p+1-th to s-th gate signals GSp+1 to GSs. In other words, the light emission control signals EM having a voltage value of an ON level may be provided to only the p+1-th to s-th light emission control lines ELp+1 to ELs, and the light emission control signals EM provided to other light emission lines EL1 to ELp and ELs+1 to Elm may still maintain a voltage value of an OFF level. Accordingly, an image may be displayed only in the second to k−1-th divided areas A2 to Ak−1 controlled by the p+1-th to s-th light emission lines ELp+1 to ELs, and the organic light emitting display device may be operated in a split drive mode.

Next, in the second frame, the same operations as those of the first frame may be repeatedly performed.

When the gate driver 200 operates as shown in FIG. 7, the data write period may be relatively short compared to when the gate driver 200 operates as shown in FIG. 6.

Even if an image is displayed only in some of the divided areas A2 to Ak−1, as in the present exemplary embodiment, the gate signals GS1 to GSm may be provided to all the gate lines GL1 to GLm corresponding to all the divided areas A1 to Ak in one frame. In this case, although the pixels PX disposed in the first and k-th divided areas A1 and Ak do not emit light during the light emission period, the data voltage charged in the first capacitor C1 included in the corresponding pixels PX may be updated for each frame. Therefore, the characteristics of the second transistor T2 of the pixel PX disposed in the second to k−1-th divided areas A2 to Ak−1 on which an image is displayed and the characteristics of the second transistor T2 of the pixel PX disposed in the first and k-th divided areas A1 and Ak on which no image is displayed may be maintained uniform. As a result, a luminance difference visually recognized by a user can be minimized. In particular, the luminance difference visually recognized by the user can be minimized when the split drive mode is ended and converted into the full drive mode.

Figure 8:
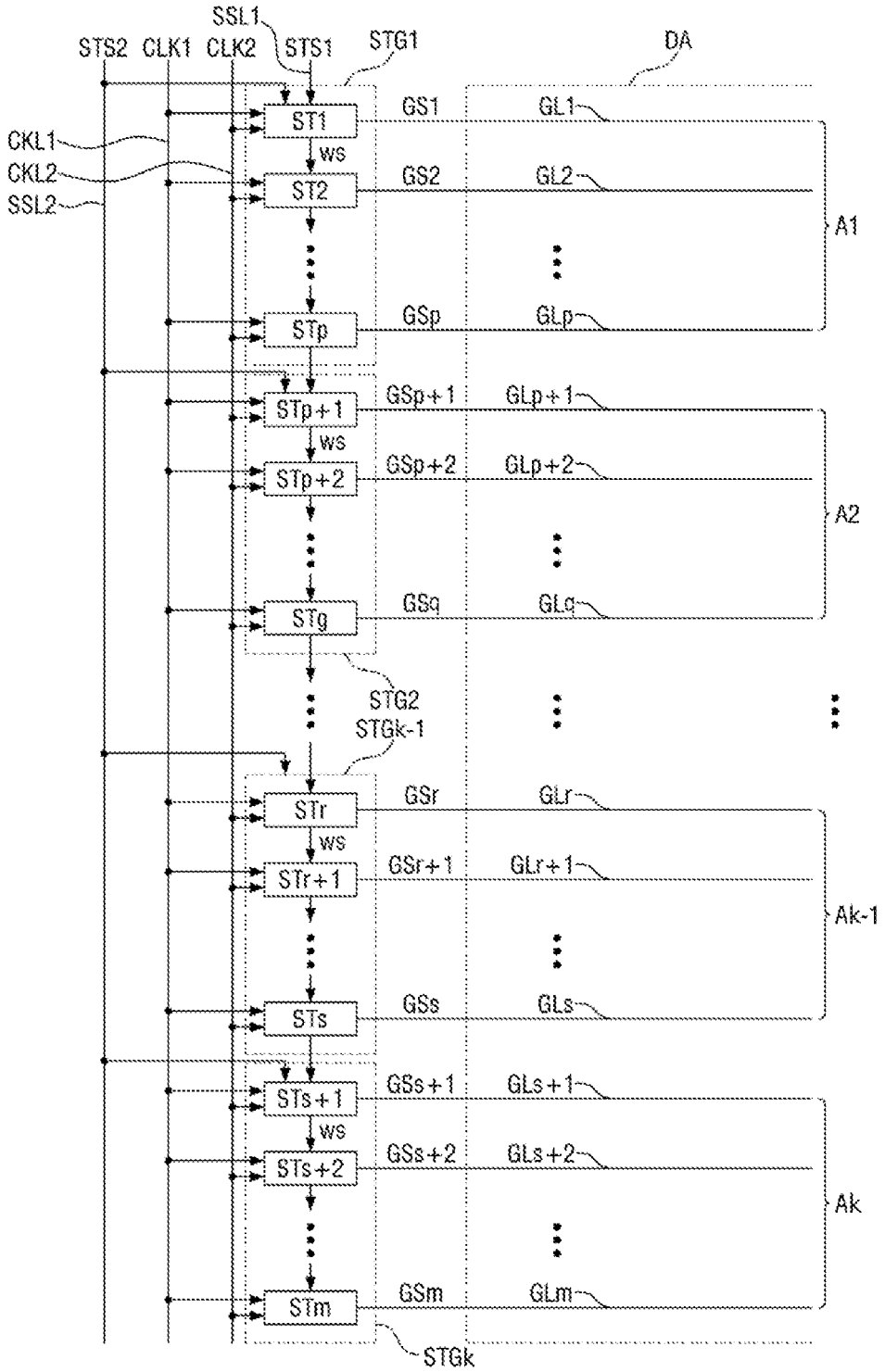
FIG. 8 is a block diagram of a gate driver according to another exemplary embodiment of the invention.

FIG. 8 is a block diagram of a gate driver according to another exemplary embodiment.

In FIG. 8, a description of components and reference numerals which are the same as those described in FIG. 5 will be omitted.

Referring to FIG. 8, the gate driver 200 includes first to k-th stage groups STG1 to STGk. Each of the first to k-th stage groups STG1 to STGk includes a plurality of stages ST1 to STm.

However, unlike the exemplary embodiment shown in FIG. 5, the gate driver 200 according to this exemplary embodiment may provide the second stage initiation signal STS2 to all the stage groups STG1 to STGk. In other words, the second stage initiation line SSL2 may be connected to the first stages of all of the stage groups STG1 to STGk (for example, first stage ST1, p+1-th stage STp+1, r-th stage STr, and s+1-th stage STs+1), and may provide the second stage initiation signal STS2 thereto.

Figure 9:
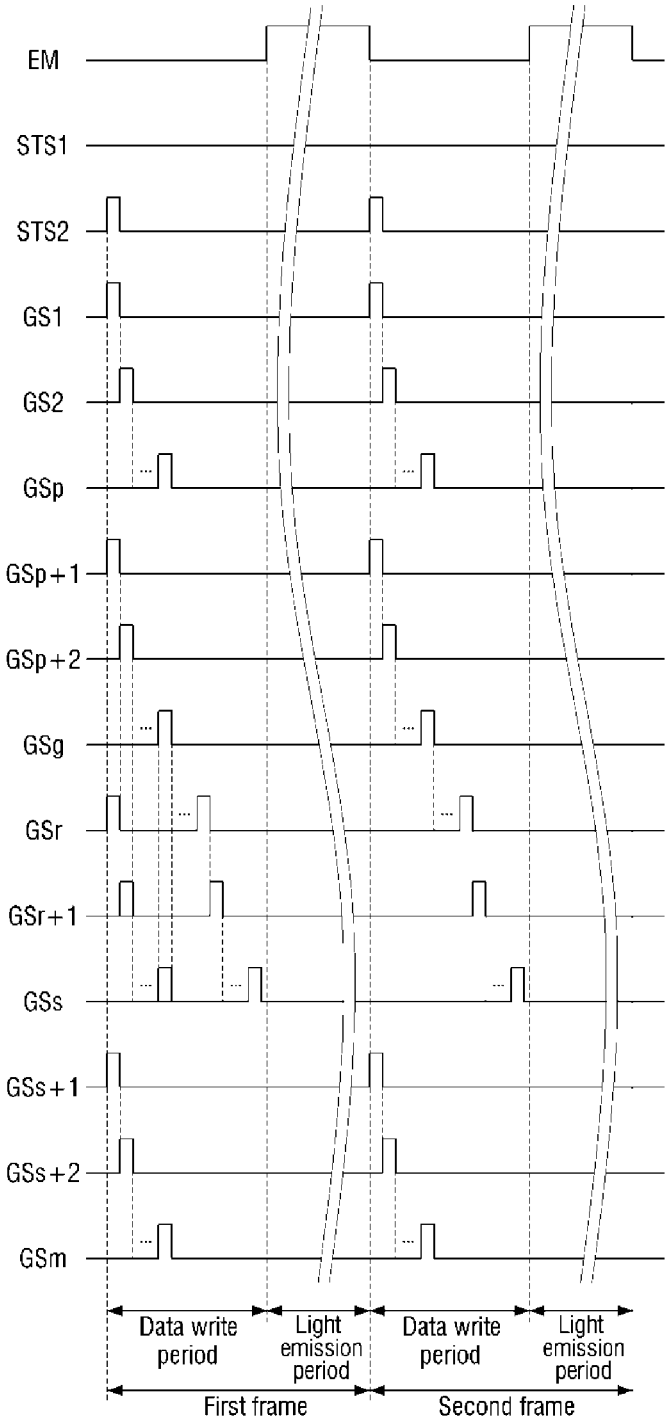
FIG. 9 is a timing chart showing the waveforms of various signals when an organic light emitting display device including the gate driver shown in FIG. 8 is driven according to a split drive mode.

FIG. 9 is a timing chart showing the waveforms of various signals when an organic light emitting display device including the gate driver shown in FIG. 8 is driven according to a split drive mode.

In FIG. 9, a description of components and reference numerals which are the same as those described in FIG. 7 will be omitted.

Referring to FIG. 9, each frame period may be divided into a data write period and a light emission period.

In this exemplary embodiment, some gate signals GSr to GSs of gate signals GSp+1 to GSs provided to second to k−1-th divided areas A2 to Ak−1 on which an image is displayed even in a split drive mode may be activated two or more times during a data write period. Although these gate signals GSr to GSs are activated two or more times, a data signal for controlling the electric current provided to the organic light emitting diode OLED may be determined at a time when each of the gate signals GSr to GSs is finally activated. Thus, the image displayed in the second to k−1-th divided areas A2 to Ak1 may be displayed correctly as intended.

In this case, the second stage initiation line SSL2 is connected to all the stage groups STG1 to STGk, and the actual driving of the stage groups STG1 to STGk may be controlled by whether or not the sequential initiation signal WS is output. Therefore, the degrees of freedom in the design of the second stage initiation line SSL2 can be increased.

Figure 10:
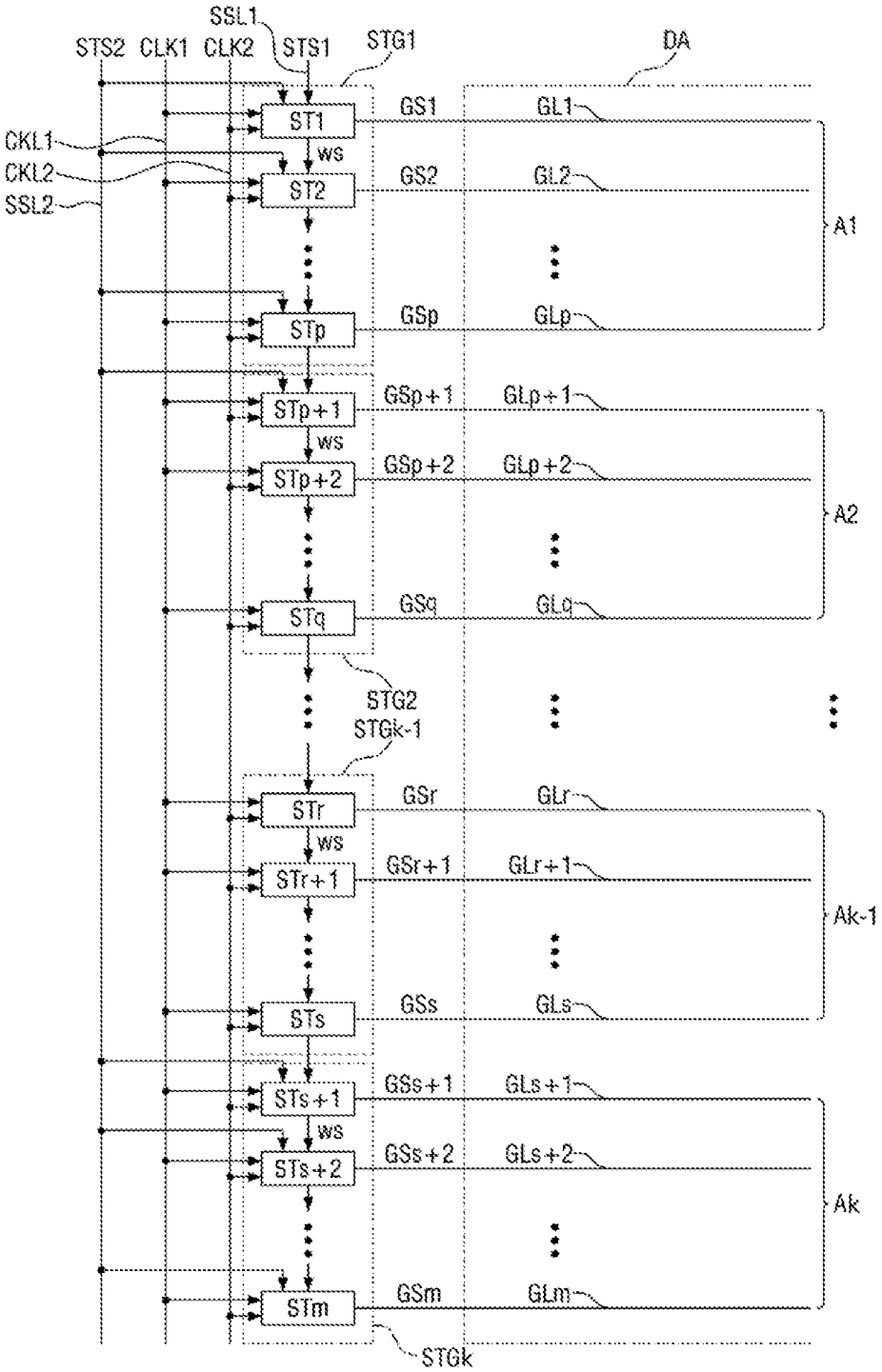
FIG. 10 is a block diagram of a gate driver according to still another exemplary embodiment of the invention.

FIG. 10 is a block diagram of a gate driver according to still another exemplary embodiment.

In FIG. 10, a description of components and reference numerals which are the same as those described in FIG. 5 will be omitted.

Referring to FIG. 10, the gate driver 200 includes first to k-th stage groups STG1 to STGk. Each of the first to k-th stage groups STG1 to STGk includes a plurality of stages ST1 to STm.

However, unlike the exemplary embodiment shown in FIG. 5, the gate driver 200 according to this exemplary embodiment may provide the second stage initiation signal STS2 to all the stage groups STG1 to STGk providing gate signals to the pixel PX in which an image is not displayed in a split drive mode and the first stage of stages providing gate signals to the pixel PX in which an image is displayed in a split drive mode.

That is, when it is assumed that the first and k-th divided areas A1 and Ak do not display an image in the split drive mode, the second stage initiation signal STS2 may be provided to the first to p+1-th stages ST1 to STp+1 and the s+1-th to m-th stages STs+1 to STm.

In this case, the first to p+1-th stages ST1 to STp+1 and the s+1-th to m-th stages STs+1 to STm, which drive the first and k-th divided areas A1 and Ak not displaying an image in the split drive mode, may not generate the sequential initiation signal WS.

Figure 11:
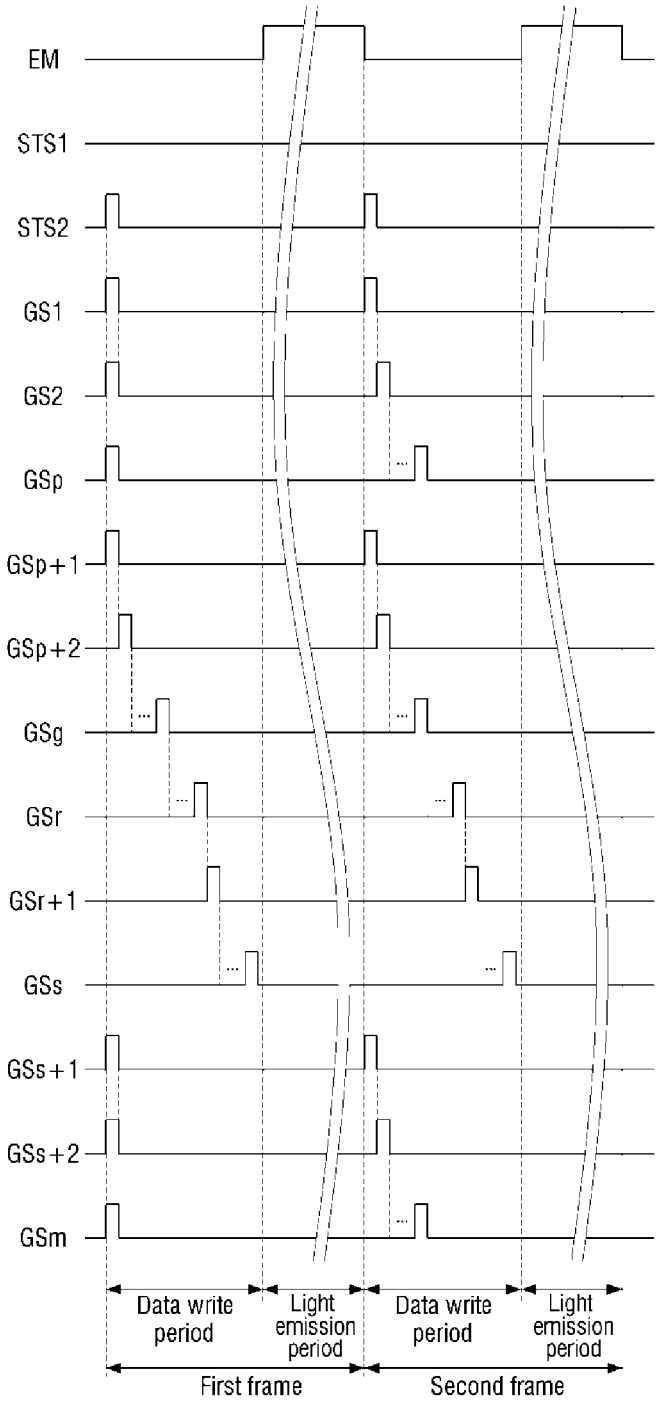
FIG. 11 is a timing chart showing the waveforms of various signals when an organic light emitting display device including the gate driver shown in FIG. 10 is driven according to a split drive mode.

FIG. 11 is a timing chart showing the waveforms of various signals when an organic light emitting display device including the gate driver shown in FIG. 10 is driven according to a split drive mode.

In FIG. 11, a description of components and reference numerals which are the same as those described in FIG. 7 will be omitted.

Referring to FIG. 11, each frame period may be divided into a data write period and a light emission period.

In this exemplary embodiment, the first to p+1-th stages ST1 to STp+1 and the s+1-th to m-th stages STs+1~STm may simultaneously activate the first to p+1-th gate signals GS1 to GSp+1 and the s+1-th to m-th gate signals. Then, the p+2-th to s-th gate signals GSp+2 to GSs driving the second to k−1-th divided areas A2 to Ak−1 may be sequentially activated.

The first capacitor C1 of the pixels PX arranged in the same pixel columns as the first to p-th and s+1-th to m-th pixel rows may be charged by the same data voltage as the first capacitor C1 of the pixels PX arranged in the same pixel columns as the p+1-th pixel row.

In this case, the charging voltage update of the first capacitor C1 of the pixels arranged in the divided areas on which an image is not displayed in a split drive mode (that is, first and k-th divided areas A1 and Ak) can be completed within minimum time.

Figure 12:
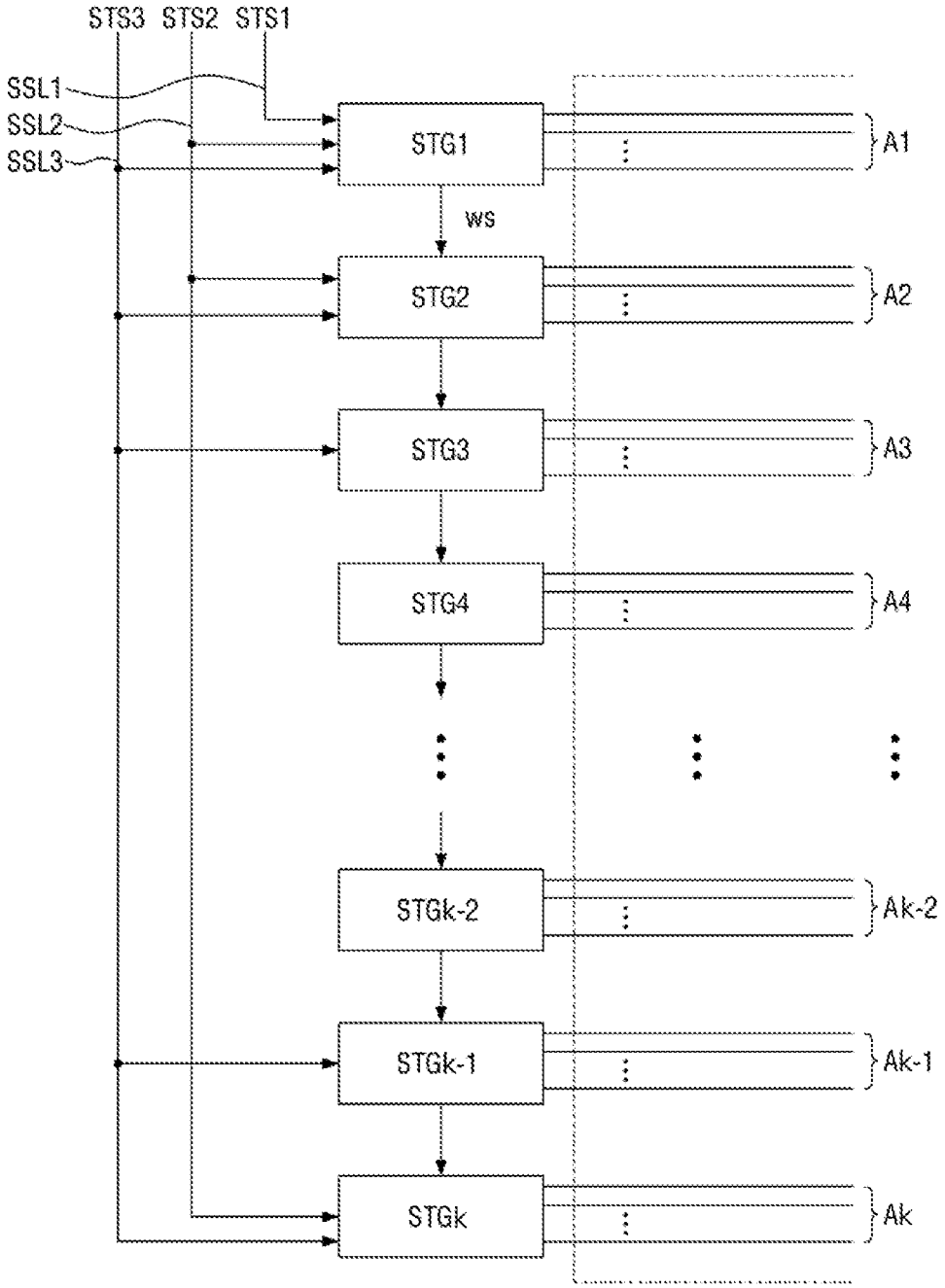
FIG. 12 is a block diagram of a gate driver according to still another exemplary embodiment of the invention.

FIG. 12 is a block diagram of a gate driver according to still another exemplary embodiment.

Referring to FIG. 12, the gate driver 200 includes first to k-th stage groups STG1 to STGk. Each of the stage groups STG1 to STGk may correspond one-to-one to the first to k-th divided areas A1 to Ak, which are divided areas of the display area DA, and may drive these first to k-th divided areas A1 to Ak.

The initiation signals provided to the gate driver 200 according to this exemplary embodiment include first to third stage initiation signals STS1 to STS3.

Specifically, the first stage initiation signal STS1 may be provided to the first stage group STG1 through the first stage line SSL1. Further, the second stage initiation signal STS2 may be provided to the first, second, and k-th stage groups STG1, STG2 and STGk through the second stage line SSL2. Further, the third stage initiation signal STS3 may be provided to the first, second, third, k−1-th, and m-th stage groups STG1, STG2, STG3, STGk−1, and STGk through the third stage line SSL3.

When operating in the split drive mode according to the second stage initiation signal STS2, it is possible to display an image using the second to k−1-th divided areas A2 to Ak−1. In contrast to this, when operating in the split drive mode according to the third stage initiation signal STS3, it is possible to display an image using the third to k−2-th divided areas A3 to Ak−1.

That is, the gate driver 200 according to this exemplary embodiment can control not only the operation in the full drive mode according to the first stage initiation signal STS1, but also the second stage initiation signal STS2 or the third stage initiation signal STS3 according to one of the plurality of split drive modes.

The present invention is not limited to the three kinds of stage initiation signals STS1 to STS3 as in this exemplary embodiment, and a larger number of stage initiation signals may be selectively provided to use a larger number of split drive modes. Further, the stage groups respectively connected with the stage initiation lines SSL1 to SSL3 may be changed at any time.

Figure 13:
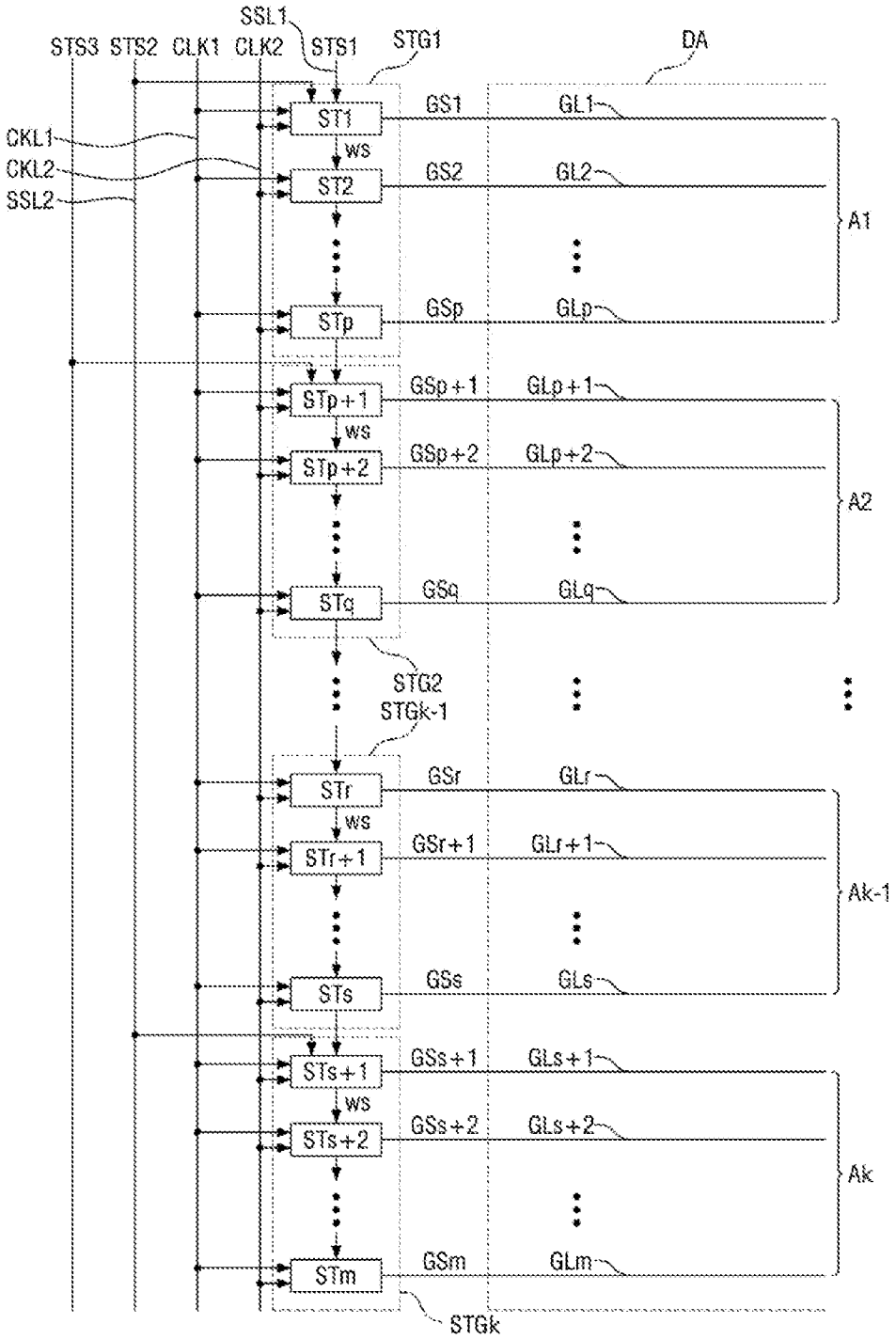
FIG. 13 is a block diagram of a gate driver according to still exemplary another embodiment of the invention.

FIG. 13 is a block diagram of a gate driver according to still another exemplary embodiment.

In FIG. 13, a description of components and reference numerals which are the same as those described in FIG. 5 will be omitted.

Referring to FIG. 13, the gate driver 200 includes first to k-th stage groups STG1 to STGk. Each of the first to k-th stage groups STG1 to STGk includes a plurality of stages ST1 to STm.

However, unlike the exemplary embodiment shown in FIG. 5, the gate driver 200 according to this exemplary embodiment may receive the first to third stage initiation signals STS1 to STS3 from the first to third stage initiation lines SSL1 to SSL3.

The first stage initiation signal STS1 may be used to operate the organic light emitting display device in the full drive mode. A detailed description thereof will be omitted herein.

The second stage initiation signal STS2 and the third stage initiation signal STS3 may be used to operate the organic light emitting display device in the split drive mode.

Specifically, the second stage initiation signal STS2 may be used to update the first capacitor C1 of the pixels PX disposed in the first and k-th divided areas A1 and Ak on which an image is not displayed in the split drive mode.

In contrast, the third stage initiation signal STS3 may be used to update the first capacitor C1 of the pixels PX disposed in the second to k−1-th divided areas A2 to Ak−1 on which an image is not displayed in the split drive mode.

In this connection structure, a data voltage to be charged in the first capacitor C1 of the pixels PX disposed in the first and k-th divided areas A1 and Ak, on which an image is not displayed in the split driving mode, may be freely set. More specifically, a data voltage to be charged in the first capacitor C1 of the pixels PX disposed in the first and k-th divided areas A1 and Ak, on which an image is not displayed in the split driving mode, may be set regardless of a data voltage to be charged in the first capacitor C1 of the pixels PX disposed in the second divided areas A2 on which an image is displayed in the split driving mode. Illustratively, a data voltage to be charged in the first capacitor C1 of the pixels PX disposed in the first and k-th divided areas A1 and Ak, on which an image is not displayed in the split driving mode, may correspond to a voltage level indicating an intermediate gradation between a maximum gradation and a minimum gradation, and may also correspond to any predetermined voltage level.

Figure 14:
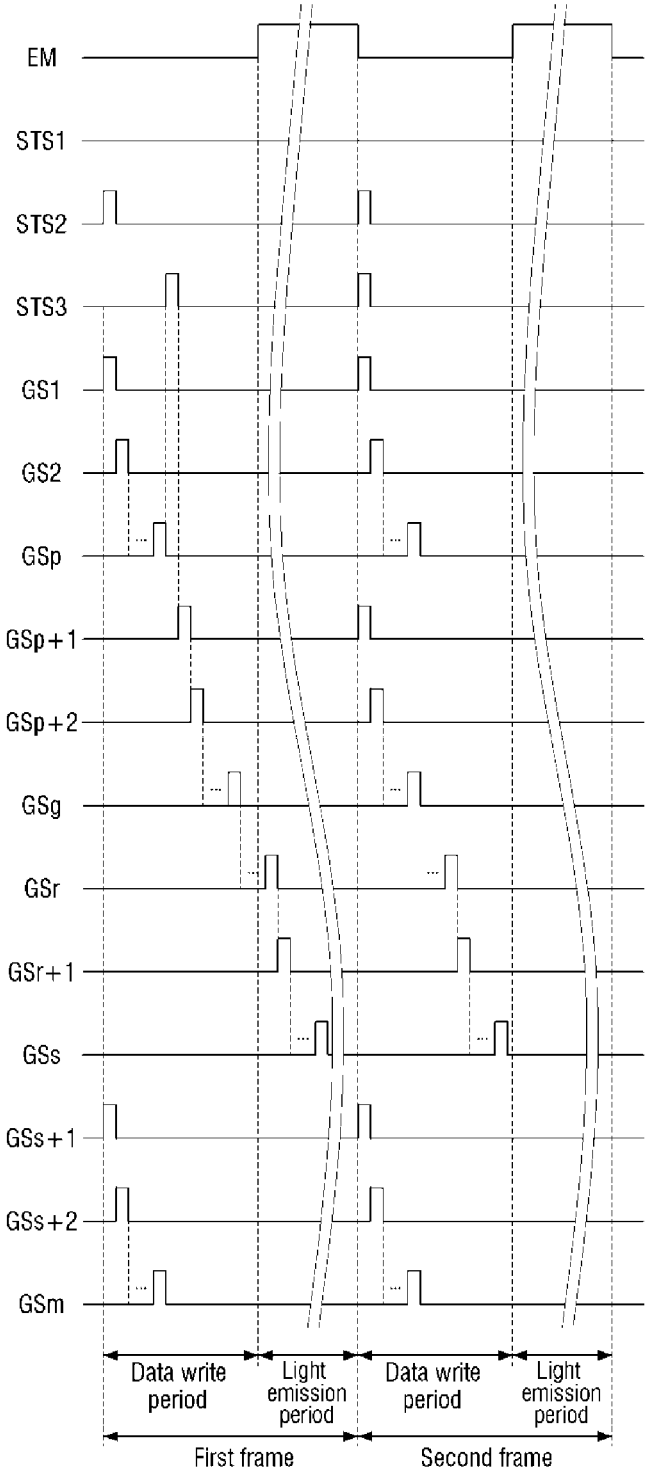
FIG. 14 is a timing chart showing the waveforms of various signals when an organic light emitting display device including the gate driver shown in FIG. 13 is driven according to a split drive mode.

FIG. 14 is a timing chart showing the waveforms of various signals when an organic light emitting display device including the gate driver shown in FIG. 13 is driven according to a split drive mode.

In FIG. 14, a description of components and reference numerals which are the same as those described in FIG. 7 will be omitted.

Referring to FIG. 14, each frame period may be divided into a data write period and a light emission period.

In this exemplary embodiment, the second stage initiation signal STS2 may be activated during the data write period. Thus, the first to p-th gate signals GS1 to GSp are sequentially activated, and, simultaneously, the s+1-th to m-th gate signals GSs+1 to GSm are also sequentially activated, so as to charge a data voltage in the first capacitor C1 of the pixels PX disposed in the first and k-th divided areas A1 and Ak.

Next, the third stage initiation signal STS3 may be activated. Thus, the p+1-th to s-th gate signals GSp+1 to GSs are also sequentially activated, so as to charge a data voltage in the first capacitor C1 of the pixels PX disposed in the second to k-th divided areas A2 to Ak−1.

Next, the light emission control signal having a voltage value of an ON level is provided to the pixels disposed in the second to k−1-th divided areas A2 to Ak−1, thereby displaying an image of one frame.

As described above, according to exemplary embodiments of the present invention, there can be provided an organic light emitting display device in which a luminance difference for each area is minimized even when a split drive mode is used.

The effects of the present invention are not limited by the foregoing, and other various effects are anticipated herein.

While the present invention has been particularly illustrated and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. An organic light emitting display device, comprising:

a display panel comprising a plurality of pixels;

a gate driver comprising a plurality of stage groups, each of the stage groups comprising at least one stage configured to provide a gate signal to the pixels;

a timing controller configured to provide a first stage initiation signal or a second stage initiation signal to the at least one stage and configured to provide a first clock signal or a second clock signal to the at least one stage;

a first stage initiation line and a second stage initiation line configured to transmit the first stage initiation signal and the second stage initiation signal respectively, from the timing controller to the gate driver; and a first clock signal line and a second clock signal line configured to transmit the first clock signal and the second clock signal respectively, from the timing controller to the gate driver, wherein:

the first stage initiation line is directly connected with one of the stage groups and is not directly connected with the other stage groups; and the second stage initiation line is directly connected with at least two of the stage groups.

2. The organic light emitting display device of claim 1, wherein the display panel includes a display area on which an image is displayed by the pixels.

3. The organic light emitting display device of claim 2, wherein the first stage initiation signal is activated when an image is displayed on the entire display area.

4. The organic light emitting display device of claim 2, wherein the second stage initiation signal is activated when an image is displayed on a portion of the entire display area.

5. The organic light emitting display device of claim 4, wherein the gate driver is configured to provide a light emission control signal for determining whether or not to emit light to the plurality of pixels.

6. The organic light emitting display device of claim 5, wherein the gate driver is configured to provide the light emission control signal having a voltage value of an ON level to the pixels disposed in a part of the display area on which an image is displayed.

7. The organic light emitting display device of claim 1, wherein each of the stages is configured to control whether or not a sequential initiation signal activating the other successively disposed stages is provided.

8. The organic light emitting display device of claim 7, wherein each of the stages is configured to provide the sequential initiation signal when the other successively disposed stages are not directly connected with the second stage initiation line.

9. The organic light emitting display device of claim 1, wherein the first stage initiation signal and the second stage initiation signal are selectively activated.

10. The organic light emitting display device of claim 1, wherein any one of the at least two stage groups directly connected with the second stage initiation line is the stage group which is directly connected with the first stage initiation line.

11. An organic light emitting display device, comprising:

a display panel comprising a plurality of pixels;

a gate driver comprising a plurality of stage groups, each of the stage groups comprising at least one stage configured to provide a gate signal to the pixels;

a timing controller configured to provide any one of first to third stage initiation signals to the at least one stage and configured to provide a first clock signal or a second clock signal to the at least one stage;

first to third stage initiation lines configured to transmit the first to third stage initiation signals respectively, from the timing controller to the gate driver; and a first clock signal line and a second clock signal line configured to transmit the first clock signal and the second clock signal respectively, from the timing controller to the gate driver, wherein:

the first stage initiation line is directly connected with one of the stage groups and is not directly connected with the other stage groups; and the second and third stage initiation line is directly connected with at least two of the stage groups.

12. The organic light emitting display device of claim 11, wherein the display panel includes a display area on which an image is displayed by the pixels.

13. The organic light emitting display device of claim 12, wherein the second stage initiation signal or the third stage initiation signal is activated when an image is displayed on a part of the display area.

14. The organic light emitting display device of claim 12, wherein:

the first stage initiation line is directly connected with the one stage group;

the second stage initiation line is directly connected with the at least two stage groups; and the third stage initiation line is directly connected with at least one of the stage groups not directly connected with the second stage initiation line.

15. The organic light emitting display device of claim 14, wherein the second stage initiation signal and the third stage initiation signal are activated at least one time in one frame.

16. The organic light emitting display device of claim 14, wherein:

the gate driver is configured to provide a light emission control signal for determining whether or not to emit light to the plurality of pixels; and the light emission control signal is provided to the pixels disposed in a part of the display area activated by the third stage initiation signal.

17. The organic light emitting display device of claim 16, wherein the pixels disposed in a part of the display area activated by the third stage initiation signal receive a predetermined data voltage.

18. The organic light emitting display device of claim 11, wherein only one of the first to third stage initiation signals is selectively activated.

* * * * *